US007506705B2

(12) United States Patent
Brandenberg et al.

(10) Patent No.: US 7,506,705 B2
(45) **Date of Patent: *Mar. 24, 2009**

(54) METHOD OF PRODUCING DOWNHOLE DRILL BITS WITH INTEGRAL CARBIDE STUDS

(75) Inventors: Kristin R Brandenberg, Berkley, MI (US); John R Keough, Ann Arbor, MI (US); Kathy L Hayrynen, Ypsilanti, MI (US); Gerald J Wurtsmith, Flat Rock, MI (US)

(73) Assignee: Applied Process, Inc., Livonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/957,270

(22) Filed: Oct. 1, 2004

(65) Prior Publication Data

US 2005/0039954 A1 Feb. 24, 2005

Related U.S. Application Data

(63) Continuation of application No. 10/229,192, filed on Aug. 27, 2002, now Pat. No. 6,799,648.

(51) Int. Cl.
*E21B 10/36* (2006.01)

(52) U.S. Cl. ..... 175/374; 175/425; 76/108.2

(58) Field of Classification Search ..... 176/374, 176/425; 76/108.2; 166/187
See application file for complete search history.

(56) References Cited

U.S. PATENT DOCUMENTS 4,014,395 A 3/1977 Pearson
4,073,354 A 2/1978 Rowley et al.
T970,002 I4 * 5/1978 Kidder et al. ..... 175/374
4,181,187 A 1/1980 Lumen
4,442,909 A 4/1984 Radtke
4,499,795 A 2/1985 Radtke
4,607,712 A 8/1986 Larsson
4,782,903 A 11/1988 Strange
4,877,096 A 10/1989 Tibbitts
4,880,278 A 11/1989 Tomlinson
5,588,497 A 12/1996 Thornburn
5,810,103 A 9/1998 Torbet
5,957,006 A * 9/1999 Smith ..... 76/108.2
5,988,303 A * 11/1999 Arfele ..... 175/374
6,068,072 A * 5/2000 Besson et al. ..... 175/432
6,655,481 B2 * 12/2003 Findley et al. ..... 175/425
6,799,648 B2 * 10/2004 Brandenberg et al. ..... 175/420

* cited by examiner

*Primary Examiner*—William P Neuder
(74) *Attorney, Agent, or Firm*—Harness, Dickey & Pierce, P.L.C.

(57) ABSTRACT

A down hole rock drill bit and method of manufacture of the same comprising a cast metal drill bit body having a plurality of hardened carbide studs partially cast in the drill bit body. The drill bit is cast by means of a foam pattern replicating the drill bit, typically made from polystyrene within which a plurality of carbide studs are partially inserted into the grinding surface of the foam drill bit model. The model is then subsequently supported within a vessel of sand and molten metal is poured over the foam, vaporizing it and taking the exact form of the foam pattern and permanently retaining the carbide studs within the metal drill bit.

11 Claims, 3 Drawing Sheets

METHOD OF PRODUCING DOWNHOLE DRILL BITS WITH INTEGRAL CARBIDE STUDS

CROSS-REFERENCE TO RELATED APPLICATIONS

This application is a continuation of U.S. patent application Ser. No. 10/229,192 filed on Aug. 27, 2002. The disclosures of the above application is incorporated herein by reference.

FIELD OF THE INVENTION present invention relates to earth boring drill bits. Specifically, this invention relates to a method of producing/manufacturing earth boring bits with integral carbide studs for downhole drilling through rock and other material.

BACKGROUND OF THE INVENTION

Rotary drill bits used in earth drilling are generally comprised of a cast, forged or machined material of significant hardness, to keep wear to the drill bit head to a minimum. To further enhance the effect of the drill, drill bit heads often utilize a plurality of hardened studs of tungsten carbide or other hard material mounted in a configuration on the head of the drill bit to increase the durability and efficiency of the bit. Conventionally, these studs are mounted in their seats upon the head of the drill bit by brazing or cementing them to the drill bit, which is economically inefficient, time consuming, and often results in the loss of studs during vigorous drilling. Furthermore, it is often necessary for the bits to be heavily machined after casting or forging prior to the attachment thereto of any carbide studs, requiring additional labor and costs.

U.S. Pat. No. 4,607,712 to inventor Larsson teaches a rock drill bit with studded inserts positioned within drilled holes, following the casting of the drill bit. This additional step of requiring the bit to be machined prior to the attachment of the studs requires significant amounts of resources and time.

U.S. Pat. No. 4,181,187 to inventor Lumen, teaches a method of attaching inserts to a rock drill bit using a press to force the hardened metal inserts into pre-bored holes in the rock drill bit head. Exemplifying the obstacle of extra tooling of the drill bit head following the casting, the present invention overcomes this by providing a cast drill bit head with hardened stud inserts already attached to the drill bit head during the casting process.

U.S. Pat. No. 4,499,795 to inventor Radtke teaches another method of drill bit manufacture wherein soft iron or steel plugs are embodied in the mold. After casting, the plugs are subsequently drilled out and cutting studs are inserted in their place. This extra machining significantly increases production time and cost to the drill bit. That will allow the final side to come U.S. Pat. No. 4,014,395 to inventor Pearson discloses a rock drill bit assembly wherein the hardened drill inserts are maintained in pre-drilled apertures in the head of the drill bit by tapered sleeves that are pressed into place around the studs. The addition of the sleeves increases production costs as well as the possibility of the incidental release of the studded insert due to the vibrations caused by the earth drilling process.

The present invention overcomes these problems, by providing a method of manufacturing a downhole drill bit with pre-cast carbide studs, creating a time and cost efficient alternative to the traditional methods of manufacturing requiring post-casting attachment of the carbide studs, followed by subsequent machining prior to use of the drill bit.

SUMMARY OF THE INVENTION

It is therefore an object of the present invention to provide for a downhole drill bit for earth boring, implementing a plurality of hardened carbide studs in the drill bit head which can be manufactured easily and economically.

A more specific object of the present invention is to provide a means for manufacturing a downhole drill bit for earth boring from Austempered ductile iron, or iron hardened by other means, utilizing a lost-foam casting process.

It is a further object of the present invention to provide for a means of casting a downhole drill bit head so as to attach a plurality of hardened carbide studs to the head of the drill bit during the casting process.

It is a more specific object of the present invention to provide a copper plating to the carbide studs prior to being set into the foam tooling thereby protecting the carbide itself during the subsequent Austemper heat treatment process.

It is another object of the present invention to embody a plurality of steel water tubes set into the foam tooling providing for appropriate flow of cooling liquid to the drill bit head without the need for post-casting machining of these passageways.

The foregoing objects are accomplished in the preferred embodiment of the present invention by providing a downhole drill bit implementing hardened carbide studs and method of manufacturing the same. The drill bit, cast from ductile iron, is formed by the lost-foam process. This process consists of making a foam pattern, generally out of polystyrene, having the exact geometry of the desired finished metal part. After a short stabilization period, the pattern is dipped into a solution containing a suspended refractory. The refractory material coats the exterior surface of the foam, leaving a thin, heat-resistant, semi-permeable coating, that is subsequently dried. When the drying is complete, the foam is suspended in a container that is agitated while sand is poured in and around the foam pattern, filling all voids in the coated pattern. The sand provides mechanical support to the thin coating.

Molten metal, preferably ductile iron, is then poured into the mold where the molten metal subsequently vaporizes the foam and replaces its volume. The solidified metal is formed into a nearly exact replica of the pattern which is subsequently heat treaded, preferably by the Austempering process, for application.

In this specific application of the lost foam casting process, a plurality of hardened carbide studs are partially inserted into the foam tooling in a predetermined pattern that maximizes efficiency of the drill, prior to the molten metal being poured into the mold. The carbide studs are plated in copper or some other suitable material prior to being set in the foam tooling to prevent degradation of the carbide material that would otherwise result from the subsequent heat treatment process. The carbide studs can be of various shapes and sizes. The studs are "blown" into the foam molds and have the necessary undercut (s) to secure them into the solidified metal and expose the appropriate cutting surface.

Not only are the carbide studs more easily attached to the drill bit head by this invention in not requiring subsequent machining of the drill bit head prior to attachment thereto of the carbide studs, but also the studs are held more securely than those implemented by alternative means, and thus the drilling head and the bits last longer and are more durable for severe drilling applications.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
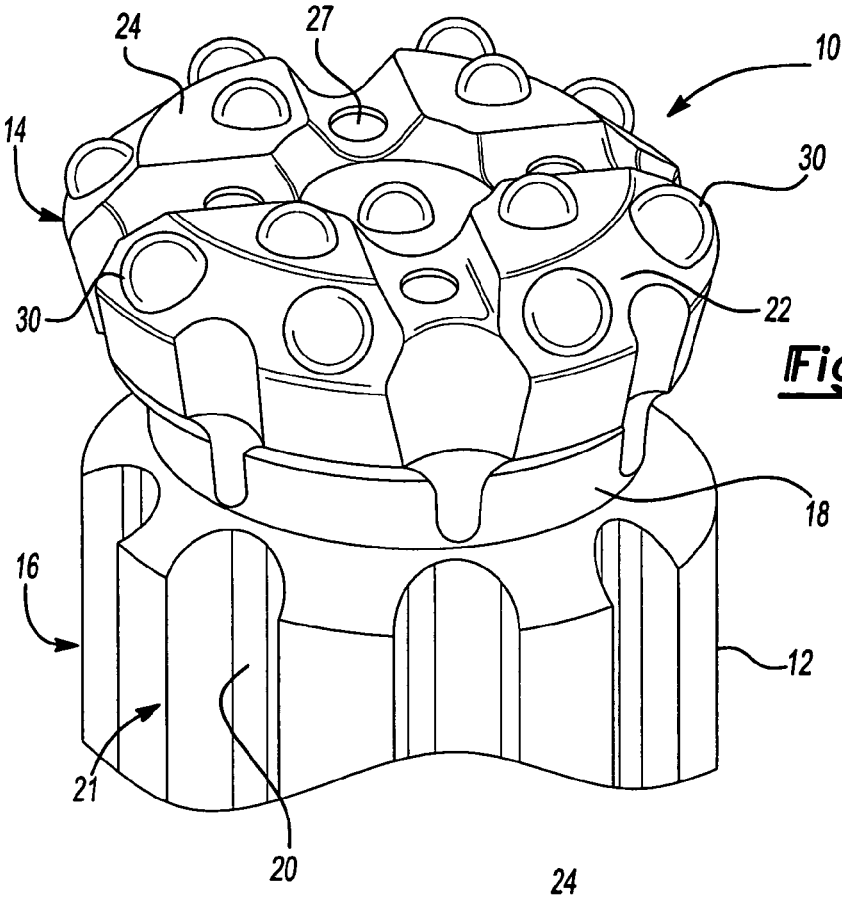
FIG. 1 is a partial perspective view of the downhole drill bit of the present invention.

Referring to the drawings by numeral, and more specifically to FIG. 1, the preferred embodiment of the present invention is shown generally numbered as 10. This drill bit comprises a generally cylindrically shaped cast iron body 12 for attaching to a down hole drilling apparatus of a conventional drill string. The body 12 is formed of cast iron or any suitable alloy, especially a high temperature alloy which will provide for greater strength and endurance. The bit body 12 has an upper grinding portion 14 and a lower shaft portion 16 which subsequently attaches to a drilling apparatus by conventional means.

Both the upper portion 14 and the lower portion 16 are separated by an annular groove 18, have a plurality of longitudinal recesses 20 within the surface of the bit, created by the mold within which the bit 10 is formed. These recesses 20 allow for material and debris that has been drilled out by the upper grinding portion 14 of the drill bit 10 to be displaced and conveyed away from the specific area of drilling, preventing the clogging of the hole with recently created debris. The recesses 20 may further provide for leading edge 21 that shaves and shapes the walls of the hole as the drill bit 10 progresses through the rock.

The upper portion 14 has a tapered section 22 providing a transition between the cylindrical sides of the drill bit and the grinding face 24 of the upper portion 14. Both the tapered section 22 and the grinding face 24 have a plurality of semi-spherical, carbide studs 30 embedded within the bit body 12, projecting outward for abrasively grinding the rock or other material through which the drill bit 10 is being used.

Figure 2:
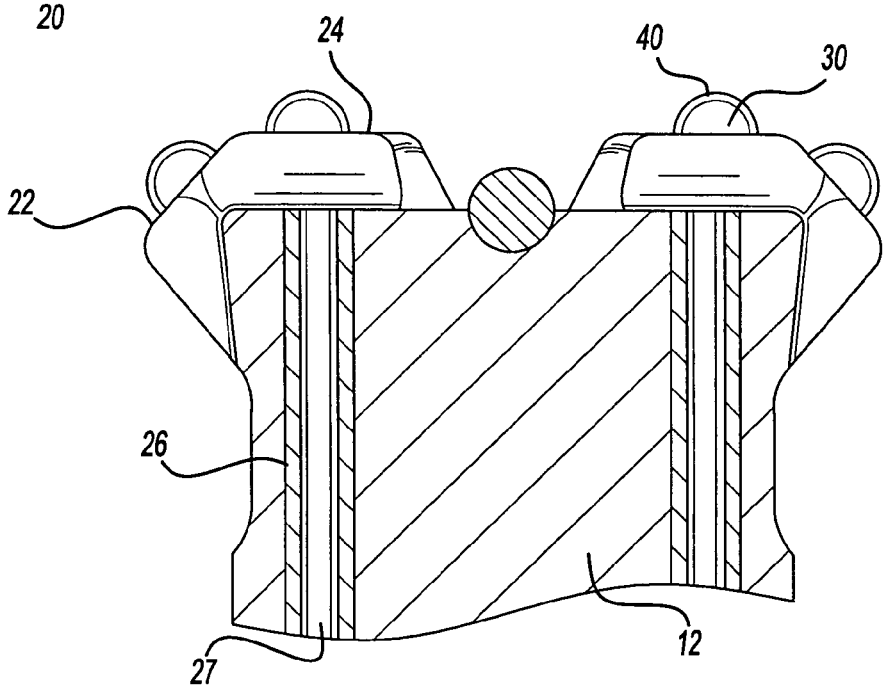
FIG. 2 is cross-sectional side view of the downhole drill bit of the present invention showing the steel tube water supply means.

Referring now to FIG. 2, a partial cross-sectional view of the upper grinding portion 14 of the drill bit 10 is shown. A plurality of steel tubes 26 having an inner channel 27 are positioned within the drill bit body 12, terminating in an aperture through the grinding face 24 of the upper portion 14. These channels 27 provide for the movement of cooling fluid to the face 24 of the drill bit 10, preventing over-heating of the drill bit due to excessive friction. The steel tubes 26 are cast in the metal body 12 of the drill bit 10 simultaneously with the carbide studs 30 during the casting process.

Figure 3:
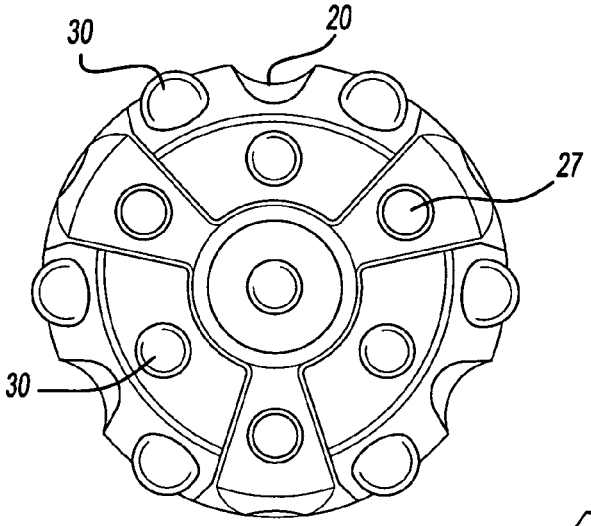
FIG. 3 is a top view of one embodiment of the downhole drill bit of the present invention.
Figure 4:
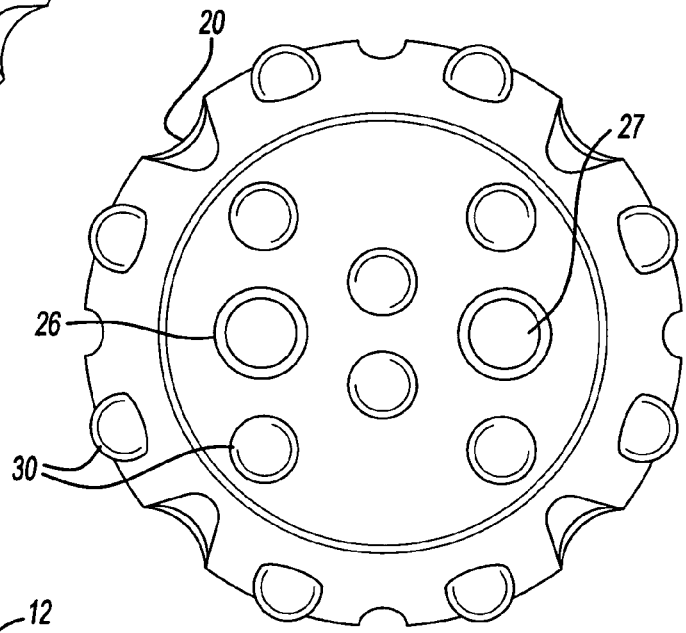
FIG. 4 is a top view of an alternative embodiment of the downhole drill bit of the present invention.
Figure 5:
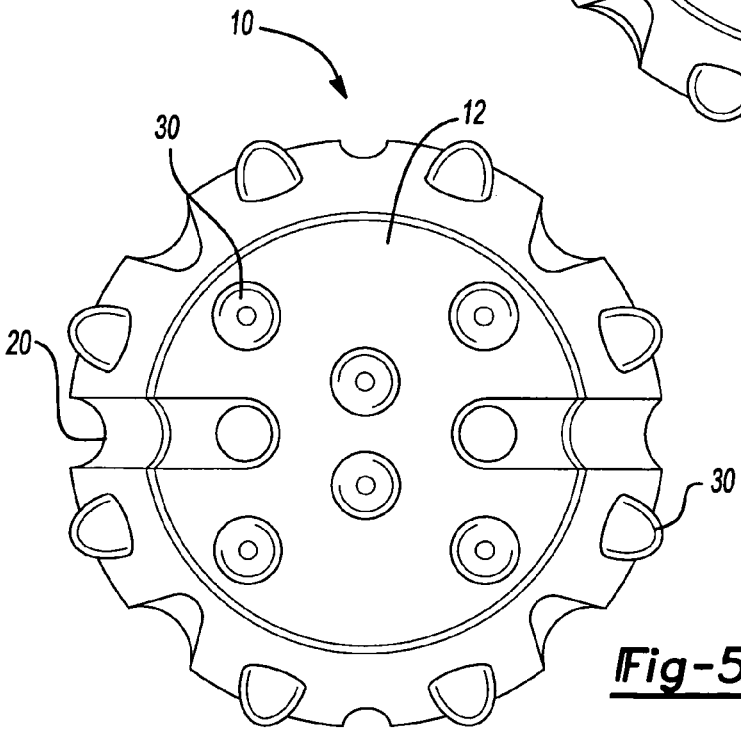
FIG. 5 shows a top view of a third embodiment of the downhole drill bit of the present invention.

FIGS. 3, 4 and 5, show frontal views of the upper grinding portion of the drill bit 10. The orientation of the carbide studs 30 and the steel cooling tubes 26 as shown can be arranged in a variety of patterns depending of the desired use or application. These illustrations in no way intend to exhaust the possible arrangements of these elements and are intended to be covered by the present invention.

In this particular invention as previously pointed out, the arrangement as well as the method of assembly and retention of the carbide studs 30 is especially important to the operation of the drill bit 10. The drill bit 10, designed to cut through rock or other hard material is subject to substantial vibration and stress. Therefore the carbide studs 30 need to be retained within the drill bit 10 in a manner which would prevent dislodgement from the various vibrations and stresses involved in the drilling process.

Figure 6:
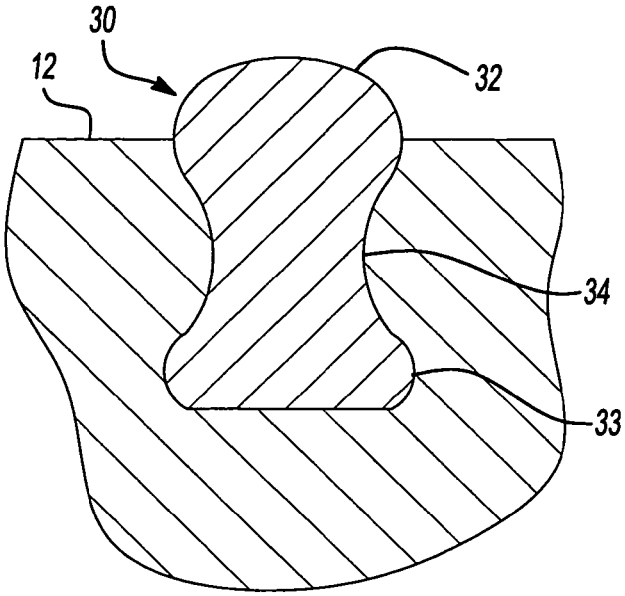
FIG. 6 shows a cross sectional close-up view of a typical carbide stud of the present invention attached to the drill bit head.
Figure 7:
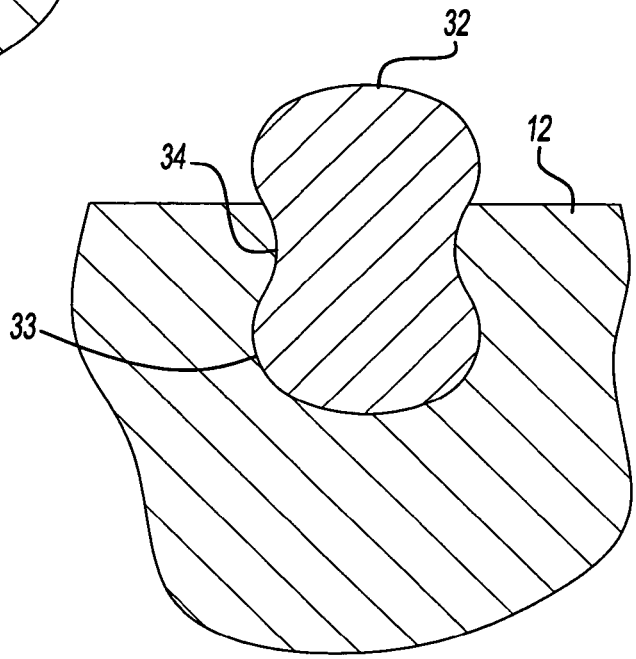
FIG. 7 shows a cross-sectional close-up view of an alternative embodiment of the carbide stud of the present invention.

Specifically referring to FIGS. 6 and 7, cross sectional views are shown of the typical carbide studs of the present invention as partially embedded in the drill bit body 12. Each typical carbide stud 30, comprising a generally hour-glass shape, has a semispherical grinding surface 32, a mounting end 33, and a narrower body portion 34 extending within the cast bit body 12. The narrower stud portion 34 provides for a retaining means to engage with the casting iron of the bit body 12, maintaining the stud 30 partially within the bit body 12 so as to expose the grinding surface 32 once the casting iron has cooled.

FIGS. 6 and 7 illustrate different embodiments of the carbide studs 30 and do not exhaust the possibilities of other carbide stud designs which are intended to be covered within the scope of this invention. The studs 30 as mentioned previously, are cast into the drill bit body 12 during the casting process, whereas molten iron flows around the narrow portion 34 of each stud 30 and solidifies, holding the stud 30 in position The casting process used in forming the drill bit is the lost-foam process. This process consists of first making a foam pattern, generally out of polystyrene, having the geometry of the desired finished metal part. After a short stabilization period, the pattern is dipped into a liquid solution containing a suspended refractory. The refractory material coats the exterior surface of the foam tooling 38 leaving a thin, heat-resistant, semi-permeable coating that is subsequently dried. When the drying is complete, the foam pattern 38 is suspended in a special container that is agitated while sand is poured in and around the foam pattern, filling all voids in the coated pattern. The sand provides mechanical support to the thin coating.

Molten metal, in this case, ductile iron, is then poured into the mold where the molten metal subsequently vaporizes the foam pattern 38. The solidified metal replaces the volume of the foam and leaves a nearly exact replica of the pattern. It is subsequently heat treated, preferably by Austempering, to harden the newly cast part for application.

Figure 8:
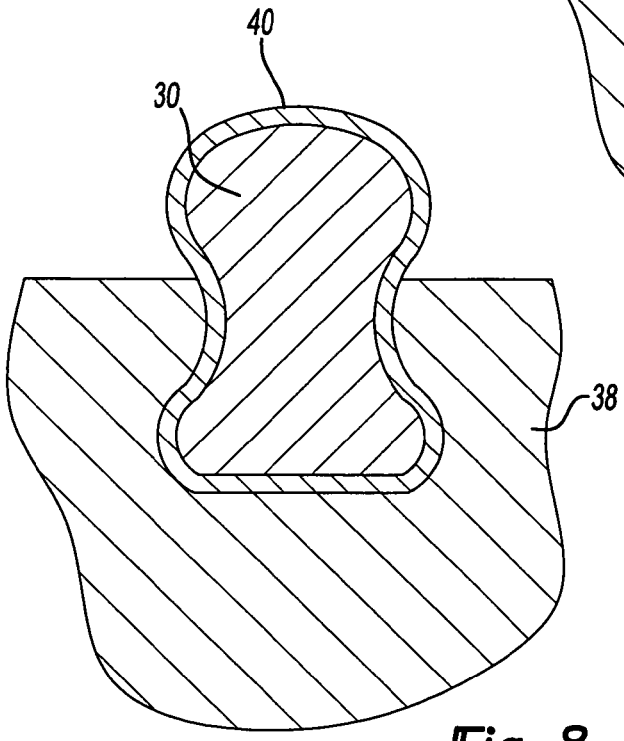
FIG. 8 shows a cross sectional side view of a carbide stud, covered by a copper plating or other suitable material.

In this specific application of the lost foam casting process for creating the drill bit 10 of the present invention, the plurality of carbide studs 30 are partially inserted into the foam tooling 38 so as to maintain the semispherical grinding portion exposed to the refractory coat and the sand. The studs 30 are arranged in a predetermined orientation that maximizes efficiency of the drill prior to the molten metal being poured into the foam pattern. Referring now specifically to FIG. 8, an individual carbide stud 30 partially mounted within the drill bit body 12 is shown. The carbide studs are plated in a thin layer of copper 40 or other suitable material prior to being set in the foam tooling 38 to protect the carbide and prevent degradation of the stud 30 that would otherwise result from the subsequent Austempering or other heat treatment process.

The casting process provides for efficient integration of the carbide studs 30 into the bit body 12, thereby preventing their incidental release during use of the drill bit 10 due to the annular recess 33 around each individual stud 30 engaging with the metal used to create the bit body 12. During use of the drill bit 10, the copper plating or other suitable material 40 rapidly wears off from the abrasion with the rock material, revealing the carbide grinding surfaces 32 which are significantly resistant to wear.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cast article comprising at least one insert molded element produced by the method of:

placing at least a first portion of at least one carbide insert element adjacent an interior surface portion of a mold having an interior shape substantially complementary to the exterior shape of the article, said carbide insert element defining an engaging surface between the first portion and a second portion, said carbide insert element being at least partially coated with a metal coating prior to being placed adjacent the interior surface of the mold;

introducing a dissolvable foam material in a relatively pourable state into the mold so as to at least partially fill the mold and at least partially surround the second portion of the at least one insert element with the foam material;

permitting the foam material to transform from the relatively pourable state to a relatively solid state comprising a monolithic molded structure of the same size and shape as the cast article and having at least one element insert molded therein;

placing a composite of the at least one element and the molded structure in an enclosure of larger volume than said composite and substantially filling the volume between the composite and the interior of the enclosure with a heat resistant casting media;

communicating a molten material into the casting media and thereby dissolving the molded structure in a manner such that the molten material flows into engagement with the second portion of the at least one element and occupies the volume and assumes the shape of the foam material, said second portion of the at least one element engages with molten material by means of a cross lobe on said second portion of the at least one element, wherein said second portion is completely surrounded by said molten material, and said first portion remains exposed;

permitting the molten material to solidify and thereby form the cast article having at least one element insert molded therein; and separating the casting media from the cast article and the at least one element.

2. The cast article according to claim 1, wherein said molten material is ductile iron.

3. The cast article of claim 1, wherein said cast article comprises a carbide studded drill bit for use in drilling through rock and earth.

4. A drill bit comprising at least one insert molded carbide stud produced by a method comprising the steps of:

placing at least a first portion of at least one carbide stud adjacent an interior surface portion of a mold, said carbide stud defines an annular groove between the first portion and a second portion;

introducing a dissolvable foam material in a relatively pourable state into the mold so as to at least partially fill the mold and partially surround the second portion of the at least one carbide stud with the foam material;

permitting the foam material to transform into a composite pre-form from the relatively pourable state to a relatively solid state comprising a monolithic molded structure of the same size and shape as the cast article and having at least one carbide stud insert molded therein;

placing the composite pre-form in an enclosure and substantially filling the volume between the composite and the interior of the enclosure with a heat resistant casting media;

communicating a molten material into the casting media and thereby dissolving the foam material in a manner such that the molten material flows into engagement with the second portion of the at least one carbide stud and occupies the volume and assumes the shape of the foam material, said second portion of the at least one carbide stud engages with molten material by means of a cross lobe on said second portion of the at least one carbide stud, wherein said second portion is completely surrounded by said molten material, and said first portion remains exposed;

permitting the molten material to solidify and thereby form the cast article having the at least one carbide stud molded therein; and separating the casting media from the cast article and the at least one carbide stud.

5. The cast article according to claim 4, wherein said molten material is ductile iron.

6. The cast article of claim 4, further comprising the step of austempering the cast article.

7. The cast article of claim 6 further comprising coating the carbide stud with copper prior to austempering.

8. The cast article of claim 4 further comprising coating the carbide stud with a metal prior to austempering.

9. The cast article of claim 4 further comprising positioning at least one steel tube which defines an inner channel within the cast article.

10. The cast article of claim 9 wherein the inner channel terminates in a aperture through a grinding face of the cast article.

11. The cast article of claim 4 further comprising forming a plurality of outer recesses in the cast article.

* * * * *